US007903789B2

(12) United States Patent
Morton et al.

(10) Patent No.: US 7,903,789 B2
(45) **Date of Patent: *Mar. 8, 2011**

(54) X-RAY TUBE ELECTRON SOURCES

(75) Inventors: Edward James Morton, Guildford (GB); Russell David Luggar, Dorking (GB); Paul De Antonis, Horsham (GB)

(73) Assignee: Rapiscan Systems, Inc., Hawthorne, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/371,853

(22) Filed: Feb. 16, 2009

(65) Prior Publication Data

US 2009/0245470 A1 Oct. 1, 2009

Related U.S. Application Data

(63) Continuation of application No. 10/554,975, filed as application No. PCT/GB2004/001741 on Apr. 23, 2004, now Pat. No. 7,512,215.

(30) Foreign Application Priority Data

Apr. 25, 2003 (GB) ..... 0309383.8

(51) Int. Cl.
*H01J 35/06* (2006.01)

(52) U.S. Cl. ..... 378/136; 378/10; 378/138

(58) Field of Classification Search ..... 378/4, 9, 378/10, 12, 14, 91–93, 98.6, 101, 113–116, 378/119, 121, 122, 124, 134–139, 145, 146
See application file for complete search history.

(56) References Cited

U.S. PATENT DOCUMENTS

| | | | |
|---|---|---|---|
| 2,952,790 | A | 9/1960 | Steen |
| 3,239,706 | A | 3/1966 | Farrell et al. |
| 3,768,645 | A | 10/1973 | Conway et al. |
| 4,057,725 | A | 11/1977 | Wagner |
| 4,105,922 | A | 8/1978 | Lambert et al. |
| 4,228,353 | A | 10/1980 | Johnson |
| 4,259,721 | A | 3/1981 | Kuznia |
| 4,266,425 | A | 5/1981 | Allport |
| 4,274,005 | A | 6/1981 | Yamamura et al. |
| 4,340,816 | A | 7/1982 | Schott |
| 4,468,802 | A | 8/1984 | Friedel |
| 4,672,649 | A | 6/1987 | Rutt |
| 4,675,890 | A | 6/1987 | Plessis et al. |
| RE32,961 | E | 6/1989 | Wagner |
| 4,866,745 | A | 9/1989 | Akai |

(Continued)

FOREIGN PATENT DOCUMENTS

| | | |
|---|---|---|
| DE | 2729353 | 1/1979 |

(Continued)

*Primary Examiner* — Jurie Yun
(74) *Attorney, Agent, or Firm* — Novel IP

(57) ABSTRACT

An X-ray tube includes an emitter wire enclosed in a suppressor. An extraction grid comprises a number of parallel wires extending perpendicular to the emitter wire, and a focusing grid comprises a number of wires parallel to the grid wires and spaced apart at equal spacing to the grid wires. The grid wire are connected by means of switches to a positive extracting potential or a negative inhibiting potential, and the switches are controlled so that at any one time a pair of adjacent grid wires are connected together to form an extracting pair, which produce an electron beam. The position of the beam is moved by switching different pairs of grid wires to the extracting potential.

33 Claims, 10 Drawing Sheets

U.S. PATENT DOCUMENTS

| | | | |
|---|---|---|---|
| 4,868,856 | A | 9/1989 | Frith et al. |
| 4,887,604 | A | 12/1989 | Shefer et al. |
| 5,033,106 | A | 7/1991 | Kita |
| 5,144,191 | A | 9/1992 | Jones et al. |
| 5,247,556 | A | 9/1993 | Eckert et al. |
| 5,259,014 | A | 11/1993 | Brettschneider |
| 5,272,627 | A | 12/1993 | Maschhoff et al. |
| 5,313,511 | A | 5/1994 | Annis et al. |
| 5,367,552 | A | 11/1994 | Peschmann |
| 5,467,377 | A | 11/1995 | Dawson |
| 5,511,104 | A | 4/1996 | Mueller et al. |
| 5,604,778 | A | 2/1997 | Polacin et al. |
| 5,633,907 | A | 5/1997 | Gravelle et al. |
| 5,689,541 | A | 11/1997 | Schardt |
| 5,841,831 | A | 11/1998 | Hell et al. |
| 5,859,891 | A | 1/1999 | Hibbard |
| 5,966,422 | A | 10/1999 | Dafni et al. |
| 5,974,111 | A | 10/1999 | Krug et al. |
| 5,987,097 | A | 11/1999 | Salasoo |
| 6,018,562 | A | 1/2000 | Willson |
| 6,122,343 | A | 9/2000 | Pidcock |
| 6,181,765 | B1 | 1/2001 | Sribar et al. |
| 6,183,139 | B1 | 2/2001 | Solomon et al. |
| 6,218,943 | B1 | 4/2001 | Ellenbogen |
| 6,236,709 | B1 | 5/2001 | Perry et al. |
| 6,269,142 | B1 | 7/2001 | Smith |
| 6,324,249 | B1 | 11/2001 | Fazzio |
| 6,546,072 | B1 | 4/2003 | Chalmers |
| 6,760,407 | B2 | 7/2004 | Price et al. |
| 2001/0022346 | A1 | 9/2001 | Katagami et al. |
| 2002/0031202 | A1 | 3/2002 | Callerame et al. |
| 2002/0094064 | A1 | 7/2002 | Zhou et al. |
| 2002/0176531 | A1 | 11/2002 | McClelland et al. |
| 2003/0031352 | A1 | 2/2003 | Nelson et al. |
| 2004/0120454 | A1 | 6/2004 | Ellenbogen et al. |
| 2004/0213378 | A1 | 10/2004 | Zhou et al. |
| 2004/0252807 | A1 | 12/2004 | Skatter et al. |
| 2004/0258305 | A1 | 12/2004 | Burnham et al. |
| 2005/0031075 | A1 | 2/2005 | Hopkins et al. |
| 2005/0053189 | A1 | 3/2005 | Gohno et al. |
| 2005/0105682 | A1 | 5/2005 | Heumann et al. |
| 2005/0111610 | A1 | 5/2005 | De Man et al. |
| 2005/0157925 | A1 | 7/2005 | Lorenz |

FOREIGN PATENT DOCUMENTS

| | | |
|---|---|---|
| EP | 0 432 568 | 6/1991 |
| EP | 0 531 993 | 3/1993 |
| EP | 0 584 871 | 3/1994 |
| EP | 0 924 742 | 6/1999 |
| EP | 0 930 046 | 7/1999 |
| EP | 1 277 439 | 1/2003 |
| EP | 1374776 | 1/2004 |
| EP | 1558142 | 8/2005 |
| GB | 1497396 | 1/1978 |
| GB | 1526041 | 9/1978 |
| GB | 2 015 245 | 9/1979 |
| GB | 2089109 | 6/1982 |
| GB | 2 212 903 | 8/1989 |
| JP | 57175247 | 10/1982 |
| JP | 590016254 | 1/1984 |
| JP | 59075549 | 4/1984 |
| JP | 60 0015546 | 1/1985 |
| JP | 60 0021440 | 2/1985 |
| JP | 04 079128 | 3/1992 |
| JP | 060038957 | 2/1994 |
| JP | 10 211196 | 8/1998 |
| JP | 2001 176408 | 6/2001 |
| JP | 2003126075 | 5/2003 |
| JP | 2004000605 | 1/2004 |
| JP | 2005013768 | 1/2005 |
| WO | WO 95/28715 | 10/1995 |
| WO | WO 99/60387 | 11/1999 |
| WO | WO 03/051201 | 6/2003 |

X-RAY TUBE ELECTRON SOURCES

CROSS-REFERENCE

The present application is a continuation of U.S. patent application No. 10/554,975, filed on Aug. 2, 2006 issued as U.S. Pat. No. 7,512,215, which is a national stage application of PCT/GB2004/01741, filed on Apr. 23, 2004 and which, in turn, relies on Great Britain Application Number 0309383.8, filed on Apr. 25, 2003, for priority.

BACKGROUND OF THE INVENTION

The present invention relates to X-ray tubes, to electron sources for X-ray tubes, and to X-ray imaging systems.

X-ray tubes include an electron source, which can be a thermionic emitter or a cold cathode source, some form of extraction device, such as a grid, which can be switched between an extracting potential and a blocking potential to control the extraction of electrons from the emitter, and an anode which produces the X-rays when impacted by the electrons. Examples of such systems are disclosed in U.S. Pat. Nos. 4,274,005 and 5,259,014.

With the increasing use of X-ray scanners, for example for medical and security purposes, it is becoming increasingly desirable to produce X-ray tubes which are relatively inexpensive and which have a long lifetime.

Accordingly the present invention provides an electron source for an X-ray scanner comprising electron emitting means defining a plurality of electron source regions, an extraction grid defining a plurality of grid regions each associated with at least a respective one of the source regions, and control means arranged to control the relative electrical potential between each of the grid regions and the respective source region so that the position from which electrons are extracted from the emitting means can be moved between said source regions.

The extraction grid may comprise a plurality of grid elements spaced along the emitting means. In this case each grid region can comprise one or more of the grid elements.

The emitting means may comprise an elongate emitter member and the grid elements may be spaced along the emitter member such that the source regions are each at a respective position along the emitter member.

Preferably the control means is arranged to connect each of the grid elements to either an extracting electrical potential which is positive with respect to the emitting means or an inhibiting electrical potential which is negative with respect to the emitting means. More preferably the control means is arranged to connect the grid elements to the extracting potential successively in adjacent pairs so as to direct a beam of electrons between each pair of grid elements. Still more preferably each of the grid elements can be connected to the same electrical potential as either of the grid elements which are adjacent to it, so that it can be part of two different said pairs.

The control means may be arranged, while each of said adjacent pairs is connected to the extracting potential, to connect the grid elements to either side of the pair, or even all of the grid elements not in the pair, to the inhibiting potential.

The grid elements preferably comprise parallel elongate members, and the emitting member, where it is also an elongate member, preferably extends substantially perpendicularly to the grid elements.

The grid elements may comprise wires, and more preferably are planar and extend in a plane substantially perpendicular to the emitter member so as to protect the emitter member from reverse ion bombardment from the anode. The grid elements are preferably spaced from the emitting means by a distance approximately equal to the distance between adjacent grid elements.

The electron source preferably further comprises a plurality of focusing elements, which may also be elongate and are preferably parallel to the grid elements, arranged to focus the beams of electrons after they have passed the grid elements. More preferably the focusing elements are aligned with the grid elements such that electrons passing between any pair of the grid elements will pass between a corresponding pair of focusing elements.

Preferably the focusing elements are arranged to be connected to an electric potential which is negative with respect to the emitter. Preferably the focusing elements are arranged to be connected to an electric potential which is positive with respect to the grid elements.

Preferably the control means is arranged to control the potential applied to the focusing elements thereby to control focusing of the beams of electrons.

The focusing elements may comprise wires, and may be planar, extending in a plane substantially perpendicular to the emitter member so as to protect the emitter member from reverse ion bombardment from an anode.

The grid elements are preferably spaced from the emitter such that if a group of one or more adjacent grid elements are switched to the extracting potential, electrons will be extracted from a length of the emitter member which is longer than the width of said group of grid elements. For example the grid elements may be spaced from the emitter member by a distance which is at least substantially equal to the distance between adjacent grid elements, which may be of the order of 5 mm.

Preferably the grid elements are arranged to at least partially focus the extracted electrons into a beam.

The present invention further provides an X-ray tube system comprising an electron source according to the invention and at least one anode. Preferably the at least one anode comprises an elongate anode arranged such that beams of electrons produced by different grid elements will hit different parts of the anode.

The present invention further provides an X-ray scanner comprising an X-ray tube according to the invention and X-ray detection means wherein the control means is arranged to produce X-rays from respective X-ray source points on said at least one anode, and to collect respective data sets from the detection means. Preferably the detection means comprises a plurality of detectors. More preferably the control means is arranged to control the electric potentials of the source regions or the grid regions so as to extract electrons from a plurality of successive groupings of said source regions each grouping producing an illumination having a square wave pattern of a different wavelength, and to record a reading of the detection means for each of the illuminations. Still more preferably the control means is further arranged to apply a mathematical transform to the recorded readings to reconstruct features of an object placed between the X-ray tube and the detector.

The present invention further provides an X-ray scanner comprising an X-ray source having a plurality of X-ray source points, X-ray detection means, and control means arranged to control the source to produce X-rays from a plurality of successive groupings of the source points each grouping producing an illumination having a square wave pattern of a different wavelength, and to record a reading of the detection means for each of the illuminations. Preferably the source points are arranged in a linear array. Preferably the detection means comprises a linear array of detectors extending in a direction substantially perpendicular to the linear array of source points. More preferably the control means is arranged to record a reading from each of the detectors for each illumination. This can enable the control means to use the readings from each of the detectors to reconstruct features of a respective layer of the object. Preferably the control means is arranged to use the readings to build up a three dimensional reconstruction of the object.

The present invention further comprises an X-ray scanner comprising an X-ray source comprising a linear array of source points, and X-ray detection means comprising a linear array of detectors, and control means, wherein the linear arrays are arranged substantially perpendicular to each other and the control means is arranged to control either the source points or the detectors to operate in a plurality of successive groupings, each grouping comprising groups of different numbers of the source points or detectors, and to analyse readings from the detectors using a mathematical transform to produce a three-dimensional image of an object. Preferably the control means is arranged to operate the source points in said plurality of groupings, and readings are taken simultaneously from each of the detectors for each of said groupings. Alternatively the control means may be arranged to operate the detectors in said plurality of groupings and, for each grouping, to activate each of the source points in turn to produce respective readings.

Preferred embodiments of the present invention will now be described by way of example only with reference to the accompanying drawings in which.

Figure 12:
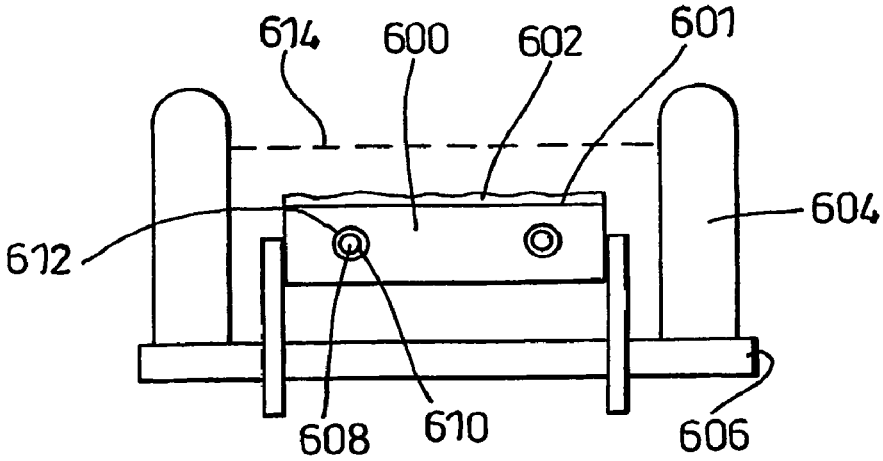
FIG. 12 is a section through an X-ray tube according to a sixth embodiment of the invention.
Figure 12A:
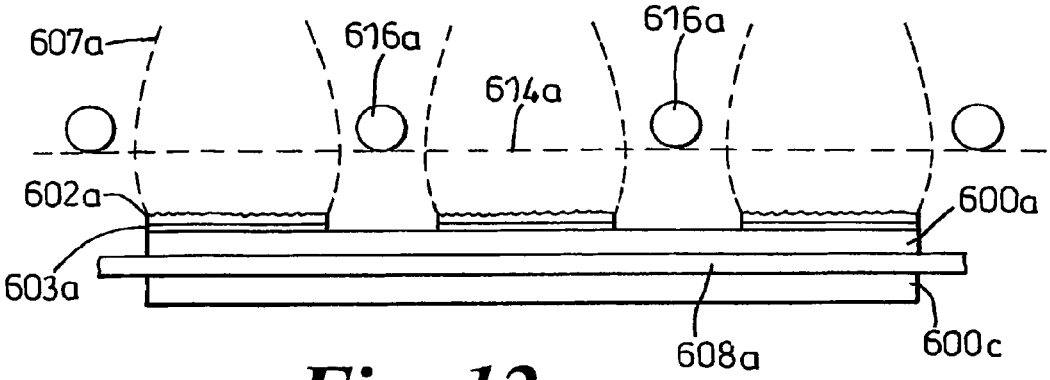
Figure 12B:
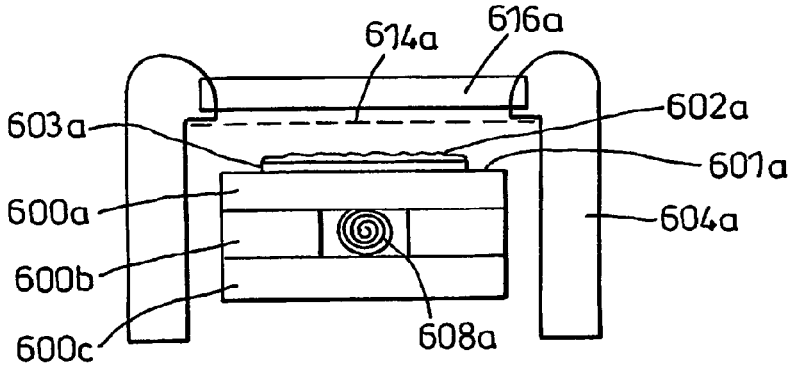

FIG. 12*a* is a longitudinal section through an X-ray tube according to a seventh embodiment of the invention;

FIG. 12*b* is a transverse section through the X-ray tube of FIG. 12*a;*

Figure 12C:
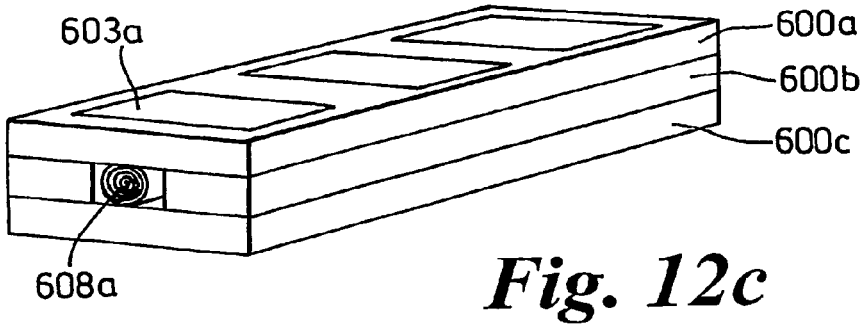

FIG. 12*c* is a perspective view of part of the X-ray tube of FIG. 12*a;*

Figure 13:
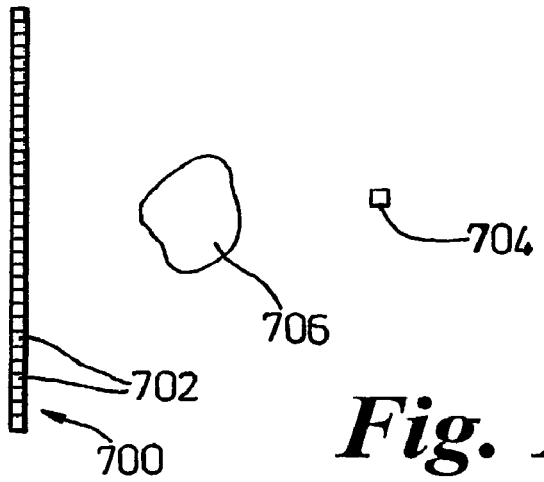
Figure 14A:
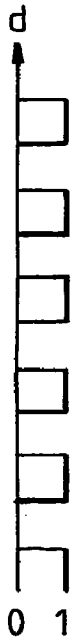
Figure 14B:
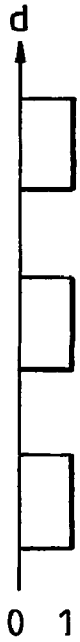
Figure 14C:
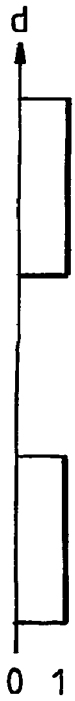
Figure 15:
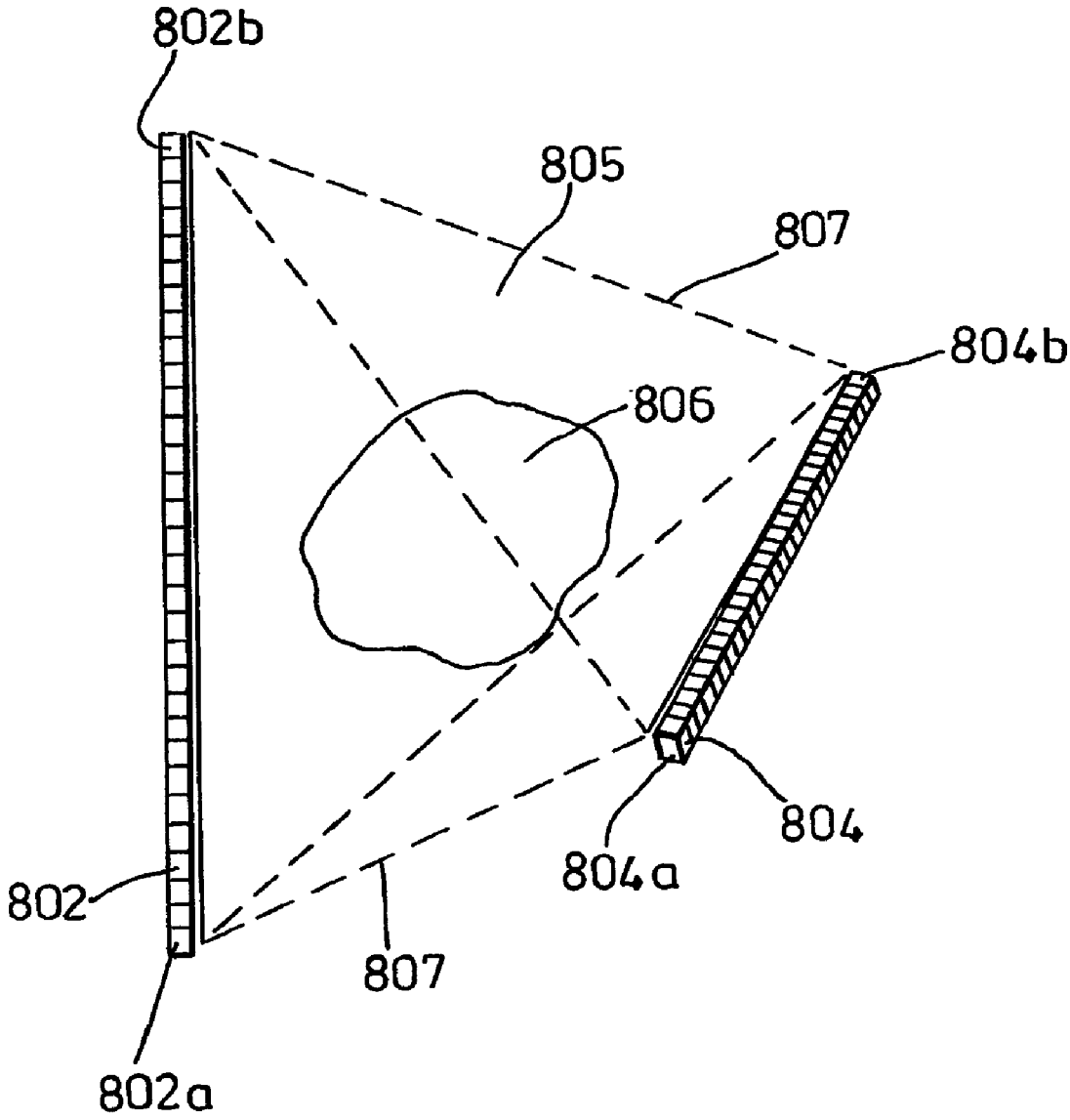
Figure 16A:
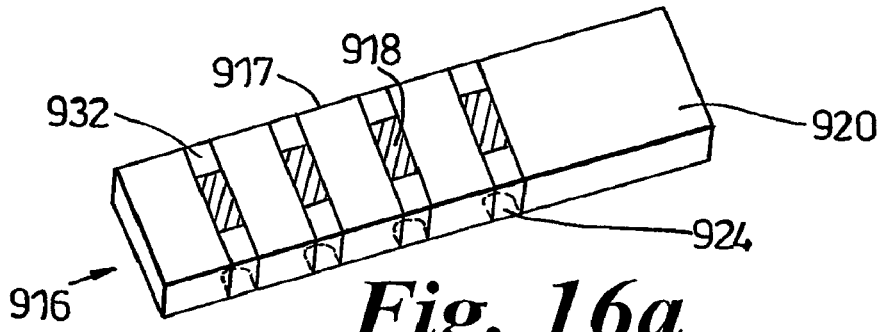
Figure 16B:
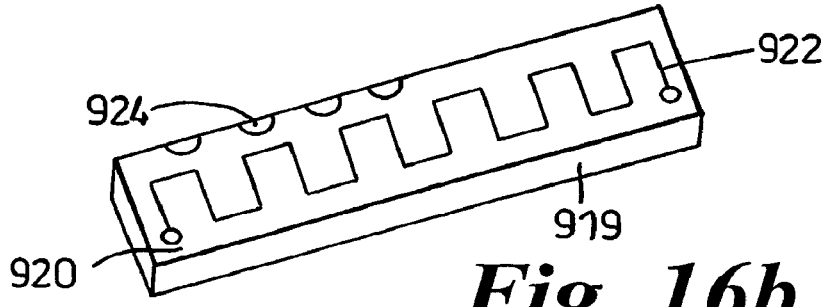
Figure 17:
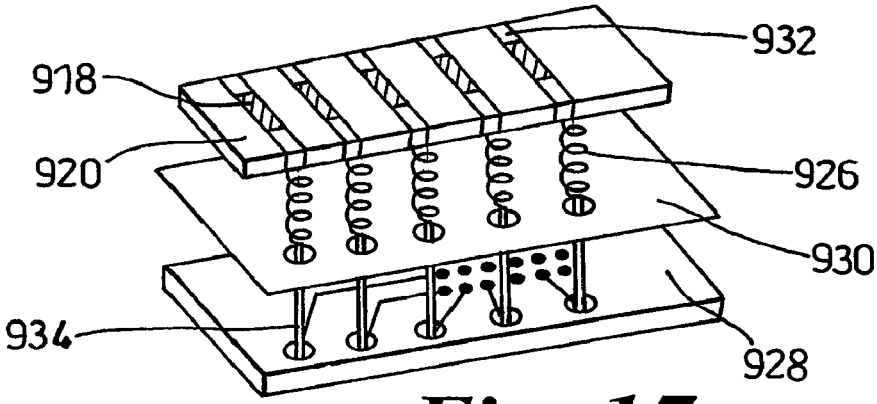
Figure 18:
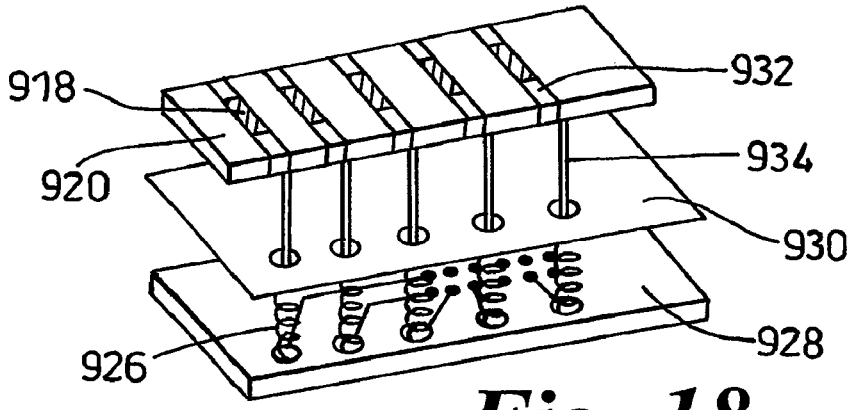

FIG. 13 is a schematic representation of an X-ray scanning system according to an eighth embodiment of the invention;

FIGS. 14*a*, 14*b* and 14*c* show operation of the system of FIG. 13;

FIG. 15 is a schematic representation of an X-ray scanning system according to a ninth embodiment of the invention;

FIGS. 16*a* and 16*b* show an emitter layer and a heater layer of an emitter according to a tenth embodiment of the invention;

FIG. 17 shows an emitter element including the emitter layer and heater layer of FIGS. 16*a* and 16*b*; and FIG. 18 shows an alternative arrangement of the emitter element shown in FIG. 17.

Figure 1:
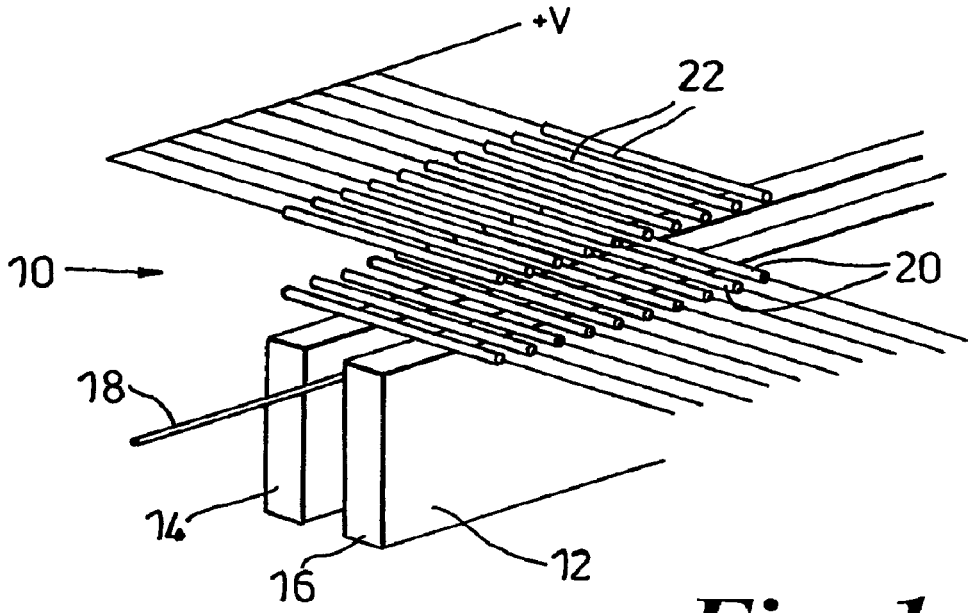
FIG. 1 shows an electron source according to the invention.

Referring to FIG. 1, an electron source 10 comprises a conductive metal suppressor 12 having two sides 14, 16, and an emitter element 18 extending along between the suppressor sides 14, 16. A number of grid elements in the form of grid wires 20 are supported above the suppressor 12 and extend over the gap between its two sides 14, 16 perpendicular to the emitter element 18, but in a plane which is parallel to it. In this example the grid wires have a diameter of 0.5 mm and are spaced apart by a distance of 5 mm. They are also spaced about 5 mm from the emitter element 18. A number of focusing elements in the form of focusing wires 22 are supported in another plane on the opposite side of the grid wires to the emitter element. The focusing wires 22 are parallel to the grid wires 20 and spaced apart from each other with the same spacing, 5 mm, as the grid wires, each focusing wire 22 being aligned with a respective one of the grid wires 20. The focusing wires 22 are spaced about 8 mm from the grid wires 20.

Figure 2:
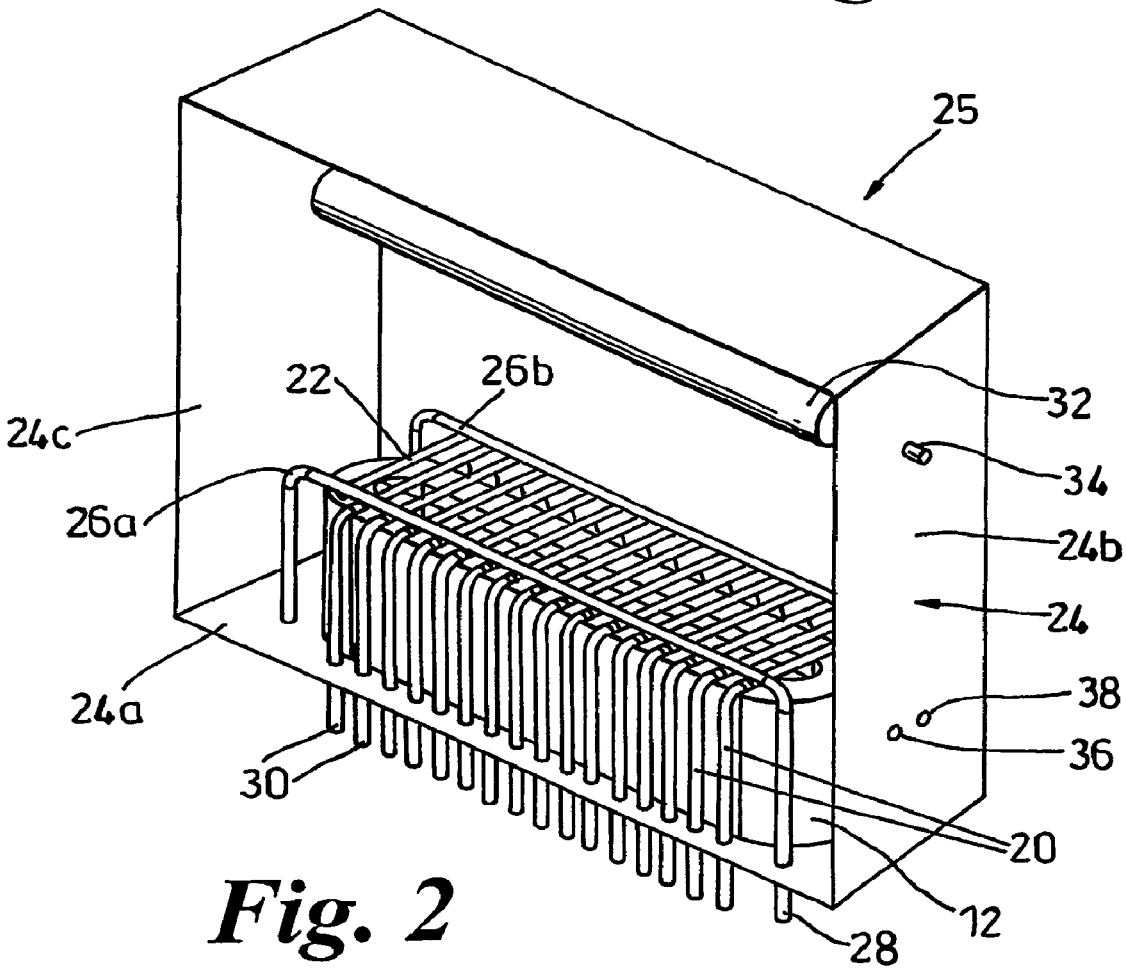
FIG. 2 shows an X-ray emitter unit including the electron source of FIG. 1.

As shown in FIG. 2, the source 10 is enclosed in a housing 24 of an emitter unit 25 with the suppressor 12 being supported on the base 24*a* of the housing 24. The focusing wires 22 are supported on two support rails 26*a*, 26*b* which extend parallel to the emitter element 18, and are spaced from the suppressor 12, the support rails being mounted on the base 24*a* of the housing 24. The support rails 26*a*, 26*b* are electrically conducting so that all of the focusing wires 22 are electrically connected together. One of the support rails 26*a* is connected to a connector 28 which projects through the base 24*a* of the housing 24 to provide an electrical connection for the focusing wires 22. Each of the grid wires 20 extends down one side 16 of the suppressor 12 and is connected to a respective electrical connector 30 which provide separate electrical connections for each of the grid wires 20.

An anode 32 is supported between the side walls 24*b*, 24*c* of the housing 24. The anode 32 is formed as a rod, typically of copper with tungsten or silver plating, and extends parallel to the emitter element 18. The grid and focusing wires 20, 22 therefore extend between the emitter element 18 and the anode 32. An electrical connector 34 to the anode 32 extends through the side wall 24*b* of the housing 24.

The emitter element 18 is supported in the ends 12*a*, 12*b* of the suppressor 12, but electrically isolated from it, and is heated by means of an electric current supplied to it via further connectors 36, 38 in the housing 24. In this embodiment the emitter 18 is formed from a tungsten wire core which acts as the heater, a nickel coating on the core, and a layer of rare earth oxide having a low work function over the nickel. However other emitter types can also be used, such as simple tungsten wire.

Figure 3:
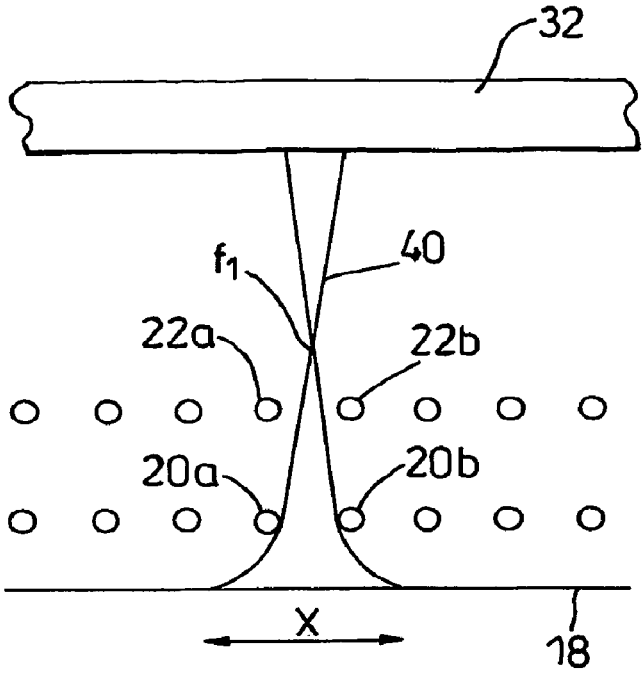
FIG. 3 is a transverse section through the unit of FIG. 2 showing the path of electrons within the unit.

Referring to FIG. 3, in order to produce a beam of electrons 40, the emitter element 18 is electrically grounded and heated so that it emits electrons. The suppressor is held at a constant voltage of typically 3-5V so as to prevent extraneous electric fields from accelerating the electrons in undesired directions. A pair of adjacent grid wires 20*a*, 20*b* are connected to a potential which is between 1 and 4 kV more positive than the emitter. The other grid wires are connected to a potential of −100V. All of the focusing wires 22 are kept at a positive potential which is between 1 and 4 kV more positive than the grid wires.

All of the grid wires 20 apart from those 20*a*, 20*b* in the extracting pair inhibit, and even substantially prevent, the emission of electrons towards the anode over most of the length of the emitter element 18. This is because they are at a potential which is negative with respect to the emitter 18 and therefore the direction of the electric field between the grid wires 20 and the emitter 18 tends to force emitted electrons back towards the emitter 18. However the extracting pair 20*a*, 20*b*, being at a positive potential with respect to the emitter 18, attract the emitted electrons away from the emitter 18, thereby producing a beam 40 of electrons which pass between the extracting wires 20*a*, 20*b* and proceed towards the anode 32. Because of the spacing of the grid wires 20 from the emitter element 18, electrons emitted from a length x of the emitter element 18, which is considerably greater than the spacing between the two grid wires 20*a*, 20*b*, are drawn together into the beam which passes between the pair of wires 20*a*, 20*b*. The grid wires 20 therefore serve not only to extract the electrons but also to focus them together into the beam 40. The length of the emitter 18 over which electrons will be extracted depends on the spacing of the grid wires 20 and on the difference in potential between the extracting pair 20*a*, 20*b* and the remaining grid wires 20.

After passing between the two extracting grid wires 20*a*, 20*b*, the beam 40 is attracted towards, and passes between the corresponding pair of focusing wires 22*a*, 22*b*. The beam converges towards a focal line f1 which is between the focusing wires 22 and the anode 32, and then diverges again towards the anode 32. The positive potential of the focus wires 22 can be varied to vary the position of the focal line f1 thereby to vary the width of the beam when it hits the anode 32.

Figure 4:
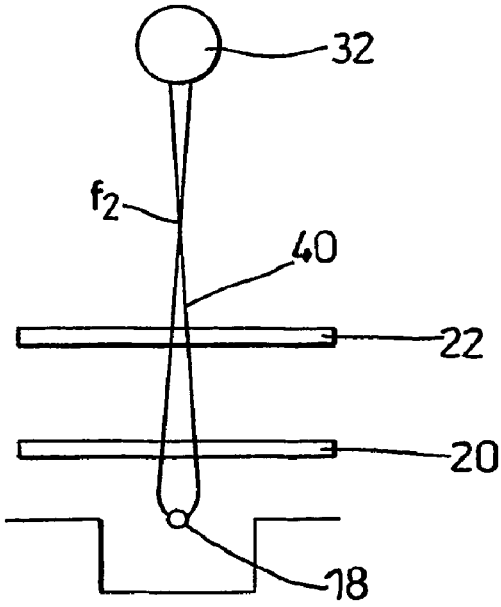
FIG. 4 is a longitudinal section through the unit of FIG. 2 showing the path of electrons within the unit.

Referring to FIG. 4, viewed in the longitudinal direction of the emitter 18 and anode 32, the electron beam 40 again converges towards a focal line f2 between the focus wires 22 and the anode 32, the position of the focal line f2 being mainly dependent on the field strength produced between the emitter 18 and anode 32.

Referring back to FIG. 2, in order to produce a moving beam of electrons successive pairs of adjacent grid wires 20 can be connected to the extracting potential in rapid succession thereby to vary the position on the anode 32 at which X-rays will be produced.

The fact that the length x of the emitter 18 from which electrons are extracted is significantly greater than the spacing between the grid wires 20 has a number of advantages. For a given minimum beam spacing, that is distance between two adjacent positions of the electron beam, the length of emitter 18 from which electrons can be extracted for each beam is significantly greater than the minimum beam spacing. This is because each part of the emitter 18 can emit electrons which can be drawn into beams in a plurality of different positions. This allows the emitter 18 to be run at a relatively low temperature compared to a conventional source to provide an equivalent beam current. Alternatively, if the same temperature is used as in a conventional source, a beam current which is much larger, by a factor of up to seven, can be produced. Also the variations in source brightness over the length of the emitter 18 are smeared out, so that the resulting variation in strength of beams extracted from different parts of the emitter 18 is greatly reduced.

Figure 5:
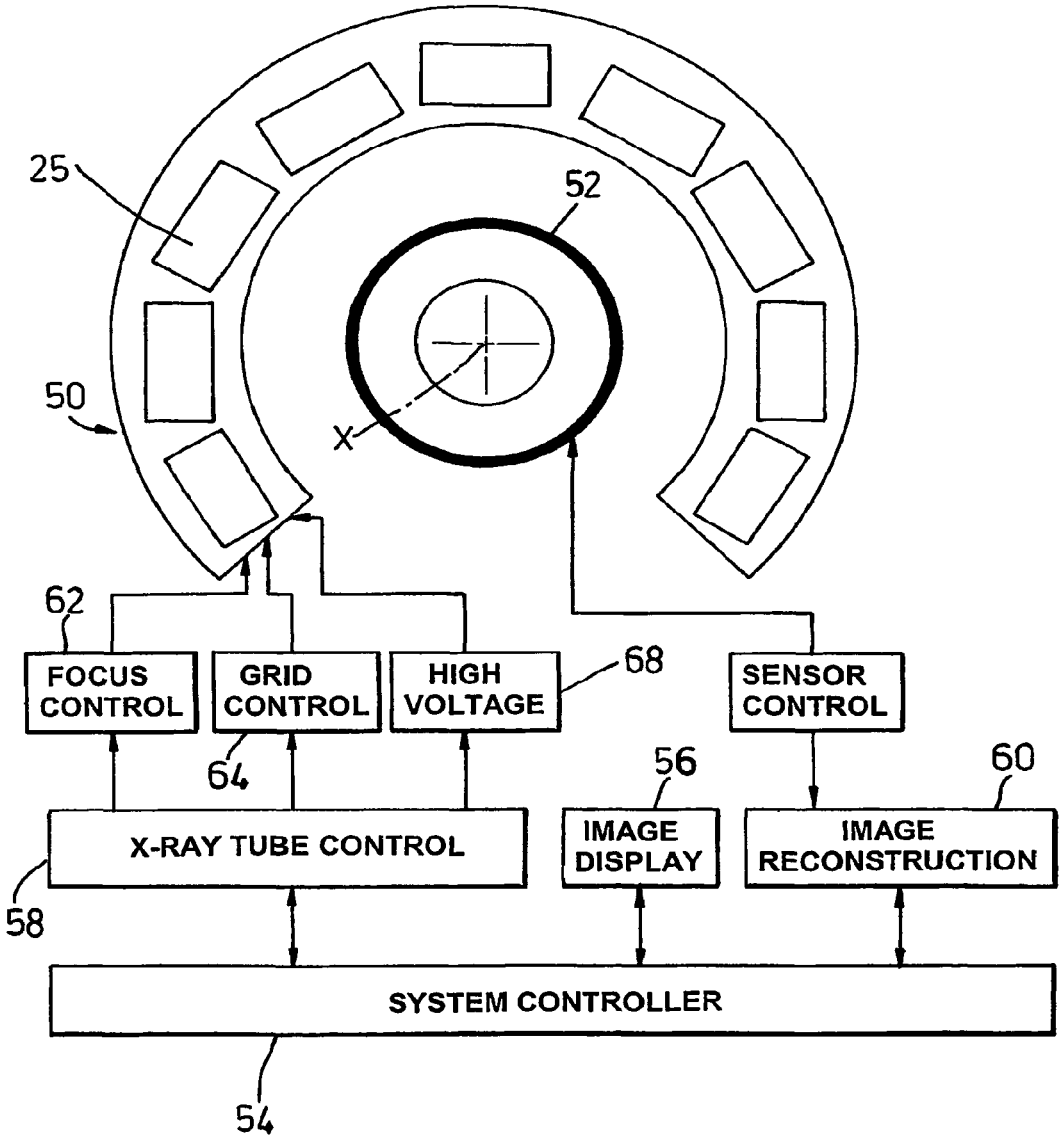
FIG. 5 is a diagram of an X-ray imaging system including a number of emitter units according to the invention.

Referring to FIG. 5, an X-ray scanner 50 is set up in a conventional geometry and comprises an array of emitter units 25 arranged in an arc around a central scanner Z axis, and orientated so as to emit X-rays towards the scanner Z axis. A ring of sensors 52 is placed inside the emitters, directed inwards towards the scanner Z axis. The sensors 52 and emitter units 25 are offset from each other along the Z axis so that X-rays emitted from the emitter units pass by the sensors nearest to them, through the Z axis, and are detected by the sensors furthest from them. The scanner is controlled by a control system which operates a number of functions represented by functional blocks in FIG. 5. A system control block 54 controls, and receives data from, an image display unit 56, an X-ray tube control block 58 and an image reconstruction block 60. The X-ray tube control block 58 controls a focus control block 62 which controls the potentials of the focus wires 22 in each of the emitter units 25, a grid control block 64 which controls the potential of the individual grid wires 20 in each emitter unit 25, and a high voltage supply 68 which provides the power to the anode 32 of each of the emitter blocks and the power to the emitter elements 18. The image reconstruction block 60 controls and receives data from a sensor control block 70 which in turn controls and receives data from the sensors 52.

In operation, an object to be scanned is passed along the Z axis, and the X-ray beam is swept along each emitter unit in turn so as to rotate it around the object, and the X-rays passing through the object from each X-ray source position in each unit detected by the sensors 52. Data from the sensors 52 for each X-ray source point in the scan is recorded as a respective data set. The data sets from each rotation of the X-ray source position can be analysed to produce an image of a plane through the object. The beam is rotated repeatedly as the object passes along the Z axis so as to build up a three dimensional tomographic image of the entire object.

Figure 6:
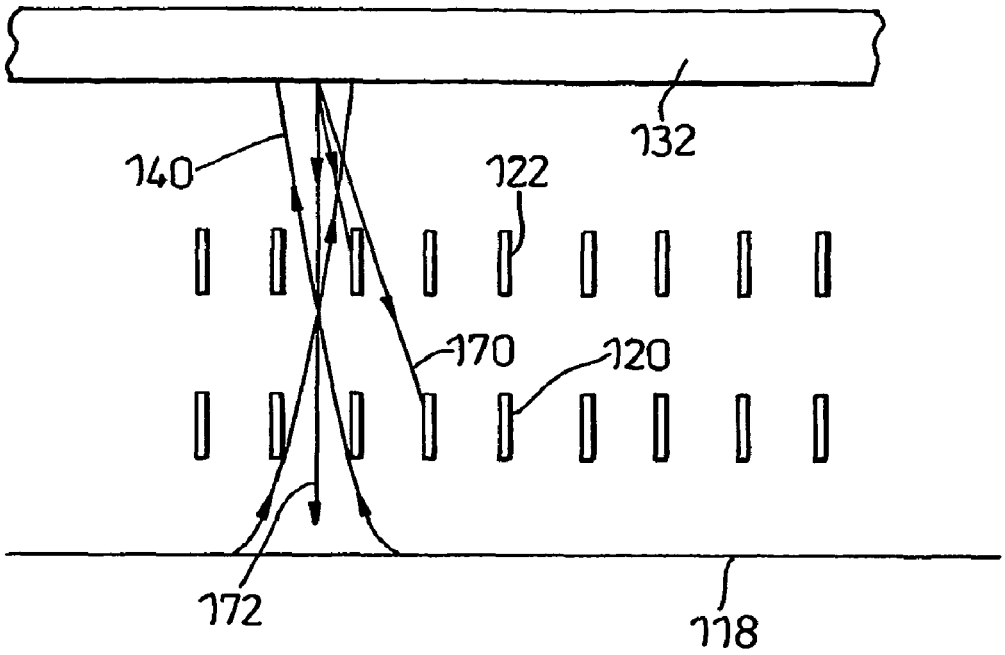
FIG. 6 is a diagram of a X-ray tube according to a second embodiment of the invention.

Referring to FIG. 6, in a second embodiment of the invention the grid elements 120 and the focusing elements 122 are formed as flat strips. The elements 120, 122 are positioned as in the first embodiment, but plane of the strips lies perpendicular to the emitter element 118 and anode 132, and parallel to the direction in which the emitter element 118 is arranged to emit electrons. An advantage of this arrangement is that ions 170 which are produced by the electron beam 140 hitting the anode 132 and emitted back towards the emitter are largely blocked by the elements 120, 122 before they reach the emitter. A small number of ions 172 which travel back directly along the path of the electron beam 140 will reach the emitter, but the total damage to the emitter due to reverse ion bombardment is substantially reduced. In some cases it may be sufficient for only the grid elements 120 or only the focusing elements 122 to be flat.

In the embodiment of FIG. 6 the width of the strips 120, 122 is substantially equal to their distance apart, i.e. approximately 5 mm. However it will be appreciated that they could be substantially wider.

Figure 7:
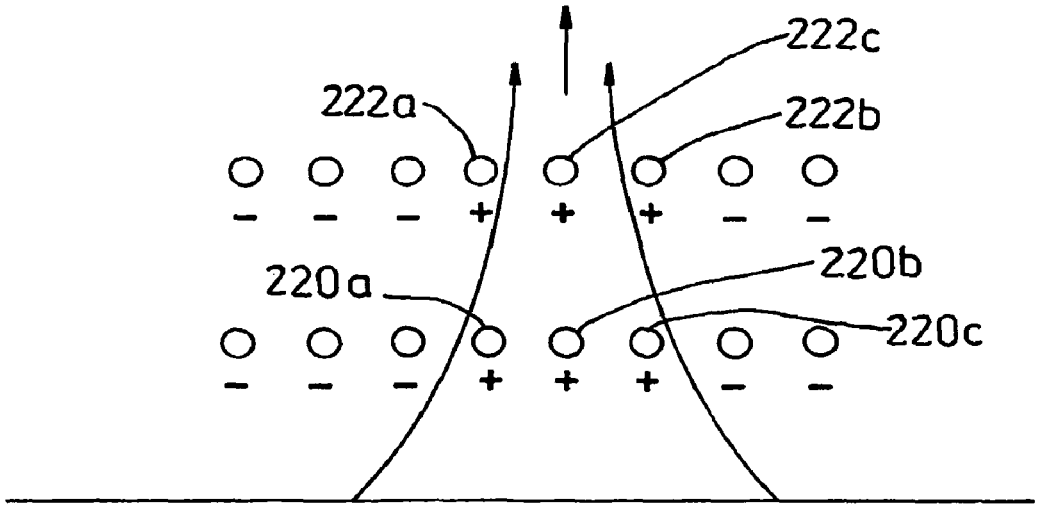
FIG. 7 is a diagram of an X-ray tube according to a third embodiment of the invention.

Referring to FIG. 7, in a third embodiment of the invention the grid elements 220 and the focusing elements 222 are more closely spaced than in the first embodiment. This enables groups of more than two of the grid elements 220*a*, 220*b*, 220*c*, three in the example shown, can be switched to the extracting potential to form an extracting window in the extracting grid. In this case the width of the extracting window is approximately equal to the width of the group of three elements 220. The spacing of the grid elements 220 from the emitter 218 is approximately equal to the width of the extracting window. The focusing elements are also connected to a positive potential by means of individual switches so that each of them can be connected to either the positive potential or a negative potential. The two focusing elements 222*a* 222*b* best suited to focusing the beam of electrons are connected to the positive focusing potential. The remaining focusing elements 222 are connected to a negative potential. In this case as there is one focusing element 222*c* between the two required for focusing, that focusing element is also connected to the positive focusing potential.

Figure 8:
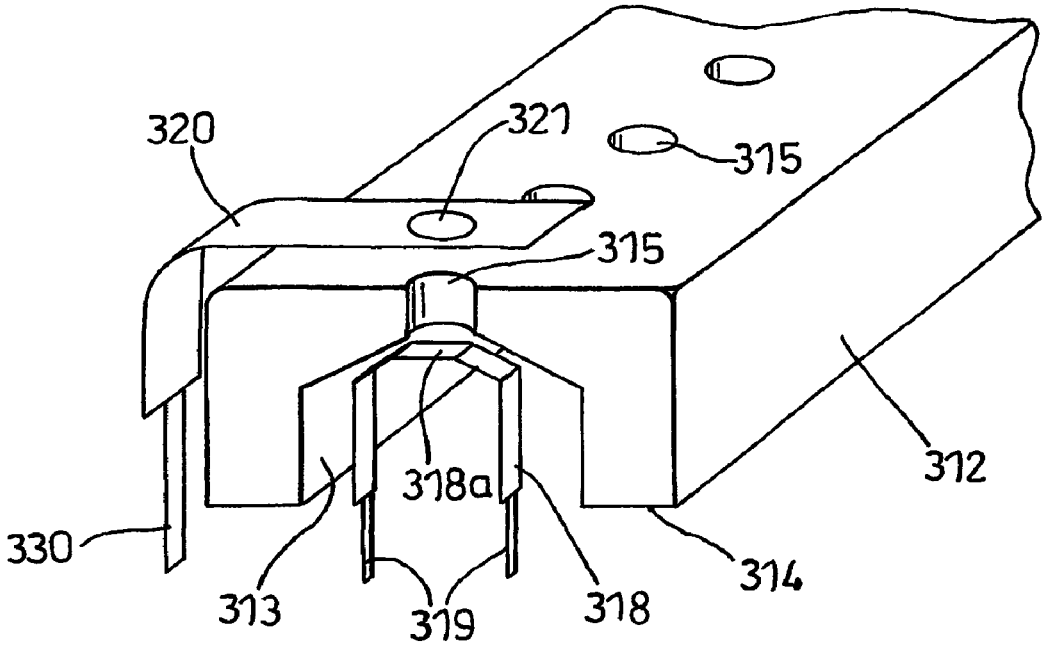
FIG. 8 is a perspective view of an X-ray tube according to a fourth embodiment of the invention.
Figure 9:
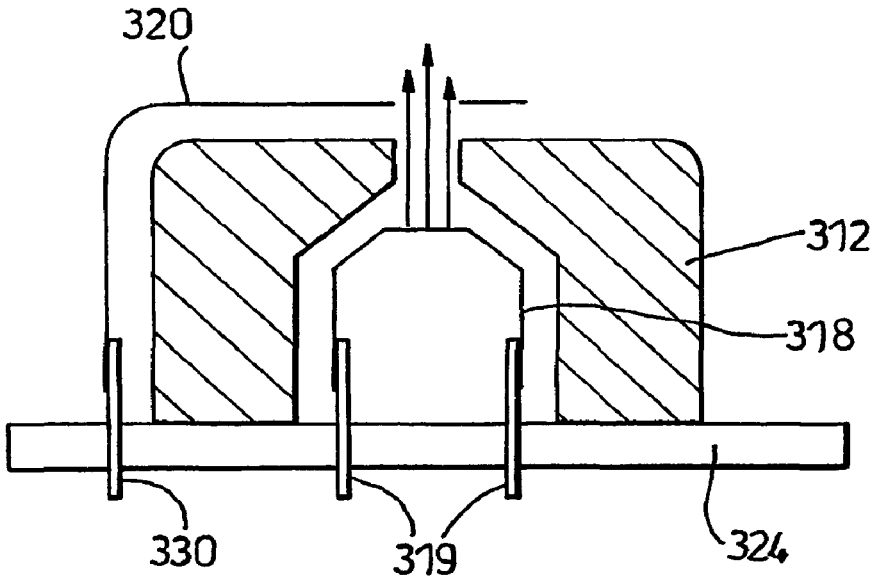
FIG. 9 is a section through the X-ray tube of FIG. 8

Referring to FIGS. 8 and 9, an electron source according to a fourth embodiment of the invention comprises a number of emitter elements 318, only one of which is shown, each formed from a tungsten metal strip which is heated by passing an electrical current through it. A region 318*a* at the centre of the strip is thoriated in order to reduce the work function for thermal emission of an electron from its surface. A suppressor 312 comprises a metallic block having a channel 313 extending along its under side 314 in which the emitter elements 318 are located. A row of apertures 315 are provided along the suppressor 312 each aligned with the thoriated region 318*a* of a respective one of the emitter elements 318. A series of grid elements 320, only one of which is shown, extend over the apertures 315 in the suppressor 312, i.e. on the opposite side of the apertures 315 to the emitter elements 318. Each of the grid elements 320 also has an aperture 321 through it which is aligned with the respective suppressor aperture 315 so that electrons leaving the emitter elements 318 can travel as a beam through the apertures 315, 320. The emitter elements 318 are connected to electrical connectors 319 and the grid elements 320 are connected to electrical connectors 330, the connectors 320, 330 projecting through a base member 324, not shown in FIG. 8, to allow an electrical current to be passed through the emitter elements 318 and the potential of the grid elements 20 to be controlled.

In operation, due to the potential difference between the emitter elements 318 and the surrounding suppressor electrode 312, which is typically less than 10V, electrons from the thoriated region 318*a* of the emitter elements 318 are extracted. Depending on the potential of the respective grid element 320 located above the suppressor 312, which can be controlled individually, these electrons will either be extracted towards the grid element 320 or they will remain adjacent to the point of emission.

In the event that the grid element 320 is held at positive potential (e.g. +300V) with respect to the emitter element 318, the extracted electrons will accelerate towards the grid element 318 and the majority will pass through a aperture 321 placed in the grid 320 above the aperture 315 in the suppressor 312. This forms an electron beam that passes into the external field above the grid 320.

When the grid element 320 is held at a negative potential (e.g. −300V) with respect to the emitter 318 the extracted electrons will be repelled from the grid and will remain adjacent to the point of emission. This cuts to zero any external electron emission from the source.

This electron source can be set up to form part of a scanner system similar to that shown in FIG. 5, with the potential of each of the grid elements 330 being controlled individually. This provides a scanner including a grid-controlled electron source where the effective source position of the source can be varied in space under electronic control in the same manner as described above with reference to FIG. 5.

Figure 10:
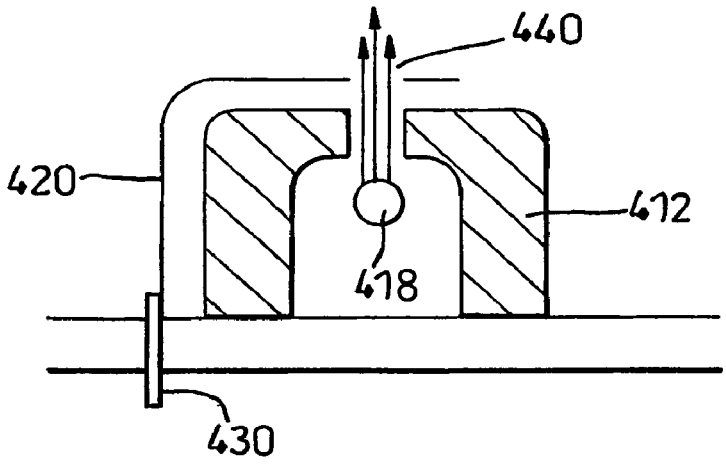
FIG. 10 is a section through an X-ray tube according to a fifth embodiment of the invention.

Referring to FIG. 10, in the fifth embodiment of the invention an electron source is similar to that of FIGS. 8 and 9 with corresponding parts indicated by the same reference numeral increased by 100. In this embodiment the emitter elements 318 are replaced by a single heated wire filament 418 placed within a suppressor box 412. A series of grid elements 420 are used to determine the position of the effective source point for the external electron beam 440. Due to the potential difference that is experienced along the length of the wire 318 because of the electric current being passed through it, the efficiency of electron extraction will vary with position.

Figure 11:
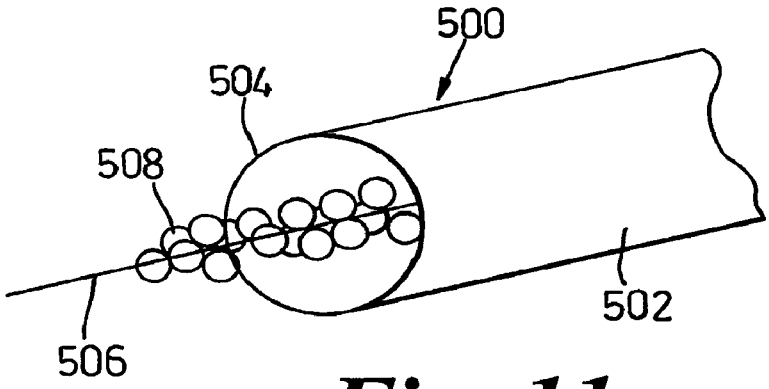
FIG. 11 shows an emitter element forming part of the X-ray tube of FIG. 10.

To reduce these variations, it is possible to use a secondary oxide emitter 500 as shown in FIG. 11. This emitter 500 comprises a low work function emitter material 502 such as strontium-barium oxide coated onto an electrically conductive tube 504, which is preferably of nickel. A tungsten wire 506 is coated with glass or ceramic particles 508 and then threaded through the tube 504. When used in the source of FIG. 10, the nickel tube 504 is held at a suitable potential with respect to the suppressor 412 and a current passed through the tungsten wire 506. As the wire 506 heats up, radiated thermal energy heats up the nickel tube 504. This in turn heats the emitter material 502 which starts to emit electrons. In this case, the emitter potential is fixed with respect to the suppressor electrode 412 so ensuring uniform extraction efficiency along the length of the emitter 500. Further, due to the good thermal conductivity of nickel, any variation in temperature of the tungsten wire 506, for example caused by thickness variation during manufacture or by ageing processes, is averaged out resulting in more uniform electron extraction for all regions of the emitter 500.

Referring to FIG. 12, in a sixth embodiment of the invention a grid controlled electron emitter comprises a small nickel block 600, typically 10×3×3 mm, coated on one side 601 (e.g. 10×3 mm) by a low work function oxide material 602 such as strontium barium oxide. The nickel block 600 is held at a potential of, for example, between +60V and +300V with respect to the surrounding suppressor electrode 604 by mounting on an electrical feedthrough 606. One or more tungsten wires 608 are fed through insulated holes 610 in the nickel block 600. Typically, this is achieved by coating the tungsten wire with glass or ceramic particles 612 before passing it through the hole 610 in the nickel block 600. A wire mesh 614 is electrically connected to the suppressor 604 and extends over the coated surface 601 of the nickel block 600 so that it establishes the same potential as the suppressor 604 above the surface 601.

When a current is passed through the tungsten wire 608, the wire heats and radiates thermal energy into the surrounding nickel block 600. The nickel block 600 heats up so warming the oxide coating 602. At around 900 centigrade, the oxide coating 602 becomes an effective electron emitter.

If, using the insulated feedthrough 606, the nickel block 600 is held at a potential that is negative (e.g. −60V) with respect to the suppressor electrode 604, electrons from the oxide 602 will be extracted through the wire mesh 614 which is integral with the suppressor 604 into the external vacuum. If the nickel block 600 is held at a potential which is positive (e.g. +60V) with respect to the suppressor electrode 604, electron emission through the mesh 614 will be cut off. Since the electrical potentials of the nickel block 600 and tungsten wire 608 are insulated from each other by the insulating particles 612, the tungsten wire 608 can be fixed at a potential typically close to that of the suppressor electrode 604.

Using a plurality of oxide coated emitter blocks 600 with one or more tungsten wires 608 to heat the set of blocks 600, it is possible to create a multiple emitter electron source in which each of the emitters can be turned on and off independently. This enables the electron source to be used in a scanner system, for example similar to that of FIG. 5.

Referring to FIGS. 12*a*, 12*b* and 12*c*, in a seventh embodiment of the invention, a multiple emitter source comprises an assembly of insulating alumina blocks 600*a*, 600*b*, 600*c* supporting a number of nickel emitter pads 603*a* which are each coated with oxide 602*a*. The blocks comprise a long rectangular upper block 600*a*, and a correspondingly shaped lower block 600*c* and two intermediate blocks 600*b* which are sandwiched between the upper and lower blocks and have a gap between them forming a channel 605*a* extending along the assembly. A tungsten heater coil 608*a* extends along the channel 605*a* over the whole length of the blocks 600*a*, 600*b*, 600*c*. The nickel pads 603*a* are rectangular and extend across the upper surface 601*a* of the upper block 600*a* at intervals along its length. The nickel pads 603*a* are spaced apart so as to be electrically insulated from each other.

A suppressor 604*a* extends along the sides of the books 600*a*, 600*b*, 600*c* and supports a wire mesh 614*a* over the nickel emitter pads 603*a*. The suppressor also supports a number of focusing wires 616*a* which are located just above the mesh 614*a* and extend across the source parallel to the nickel pads 603*a*, each wire being located between two adjacent nickel pads 603*a*. The focusing wires 616*a* and the mesh 614*a* are electrically connected to the suppressor 604*a* and are therefore at the same electrical potential.

As with the embodiment of FIG. 12, the heater coil 608*a* heats the emitter pads 603*a* such that the oxide layer can emit electrons. The pads 603*a* are held at a positive potential, for example of +60V, with respect to the suppressor 604*a*, but are individually connected to a negative potential, for example of −60V, with respect to the suppressor 604*a* to cause them to emit. As can best be seen in FIG. 12*a*, when any one of the pads 603*a* is emitting electrons, these are focused into beam 607*a* by the two focusing wires 616*a* on either side of the pads 603*a*. This is because the electric field lines between the emitter pads 603*a* and the anode are pinched inwards slightly where they pass between the focusing wires 616*a*.

Referring to FIG. 13, in an eighth embodiment of the invention, an X-ray source 700 is arranged to produce X-rays from each of a series of X-ray source points 702. These can be made up of one or more anodes and a number of electron sources according to any of the embodiments described above. The X-ray source points 702 can be turned on and off individually. A single X-ray detector 704 is provided, and the object 706 to be imaged is placed between the X-ray source and the detector. An image of the object 706 is then built up using Hadamard transforms as described below.

Referring to FIGS. 14*a* to 14*c*, the source points 702 are divided into groups of equal numbers of adjacent points 702. For example in the grouping shown in FIG. 14*a*, each group consists of a single source point 702. The source points 702 in alternate groups are then activated simultaneously, so that in the grouping of FIG. 14*a* alternate source points 702*a* are activated, while each source point 702*b* between the activated source points 702*a* is not activated. This produces a square wave illumination pattern with a wavelength equal to the width of two source points 702*a*, 702*b*. The amount of X-ray illumination measured by the detector 704 is recorded for this illumination pattern. Then another illumination pattern is used as shown in FIG. 14*b* where each group of source points 702 comprises two adjacent source points, and alternate groups 702*c* are again activated, with the intervening groups 702*d* not being activated. This produces a square wave illumination pattern as shown in FIG. 14*b* with a wavelength equal to the width of four of the source points 702. The amount of X-ray illumination at the detector 704 is again recorded. This process is then repeated as shown in FIG. 14*c* with groups of four source points 702, and also with a large number of other group sizes. When all of the group sizes have been used and the respective measurements associated with the different square wave illumination wavelengths taken, the results can be used to reconstruct a full image profile of the 2D layer of the object 706 lying between the line of source points 702 and the detector 704 using Hadamard transforms. It is an advantage of this arrangement that, instead of the source points being activated individually, at any one time half of the source points 702 are activated and half are not. Therefore the signal to noise ratio of this method is significantly greater than in methods where the source points 702 are activated individually to scan along the source point array.

A Hadamard transform analysis can also be made using a single source on one side of the object and a linear array of detectors on the other side of the object. In this case, instead of activating the sources in groups of different sizes, the single source is continually activated and readings from the detectors are taken in groups of different sizes, corresponding to the groups of source points 702 described above. The analysis and reconstruction of the image of the object are similar to that used for the FIG. 13 arrangement.

Referring to FIG. 15, in a modification to this arrangement the single detector of FIG. 13 is replaced by a linear array of detectors 804 extending in a direction perpendicular to the linear array of source points 802. The arrays of source points 802 and detectors 804 define a three dimensional volume 805 bounded by the lines 807 joining the source points 802*a* 802*b* at the ends of the source point array to the detectors 804*a*, 804*b* at the ends of the detector array. This system is operated exactly as that in FIG. 13, except that for each square wave grouping of source points illuminated, the X-ray illumination at each of the detectors 804 is recorded. For each detector a two dimensional image of a layer of the object 806 within the volume 805 can be reconstructed, and the layers can then be combined to form a fully three dimensional image of the object 806.

Referring to FIGS. 16*a* and 16*b*, 17 and 18, in a further embodiment, the emitter element 916 comprises an AlN emitter layer 917 with low work function emitters 918 formed on it and a heater layer 919 made up of Aluminium Nitride (AlN) substrate 920 and a Platinum (Pt) heater element 922, connected via interconnecting pads 924. Conducting springs 926 then connect the AlN substrate 920 to a circuit board 928. Aluminium nitride (AlN) is a high thermal conductivity, strong, ceramic material and the thermal expansion coefficient of AlN is closely matched to that of platinum (Pt). These properties lead to the design of an integrated heater-electron emitter 916 as shown in FIGS. 16*a* and 16*b* for use in X-ray tube applications.

Typically the Pt metal is formed into a track of 1-3 mm wide with a thickness of 10-100 microns to give a track resistance at room temperature in the range 5 to 50 ohms. By passing an electrical current through the track, the track will start to heat up and this thermal energy is dissipated directly into the AlN substrate. Due to the excellent thermal conductivity of AlN, the heating of the AlN is very uniform across the substrate, typically to within 10 to 20 degrees. Depending on the current flow and the ambient environment, stable substrate temperatures in excess of 1100 C can be achieved. Since both AlN and Pt are resistant to attack by oxygen, such temperatures can be achieved with the substrate in air. However, for X-ray tube applications, the substrate is typically heated in vacuum.

Referring to FIG. 17, heat reflectors 930 are located proximate to the heated side of the AlN substrate 920 to improve the heater efficiency, reducing the loss of heat through radiative heat transfer. In this embodiment, the heat shield 930 is formed from a mica sheet coated in a thin layer of gold. The addition of a titanium layer underneath the gold improves adhesion to the mica.

In order to generate electrons, a series of Pt strips 932 are deposited onto the AlN substrate 920 on the opposite side of the AlN substrate to the heater 922 with their ends extending round the sides of the substrate and ending in the underside of the substrate where they form the pads 924. Typically these strips 932 will be deposited using Pt inks and subsequent thermal baking. The Pt strips 932 are then coated in a central region thereof with a thin layer of Sr;Ba;Ca carbonate mixture 918. When the carbonate material is heated to temperatures typically in excess of 700 C, it will decompose into Sr:Ba:Ca oxides—low work function materials that are very efficient electron sources at temperatures of typically 700-900 C.

In order to generate an electron beam, the Pt strip 932 is connected to an electrical power source in order to source the beam current that is extracted from the Sr:Ba:Ca oxides into the vacuum. In this embodiment this is achieved by using an assembly such as that shown in FIG. 17. Here, a set of springs 926 provides electrical connection to the pads 924 and mechanical connection to the AlN substrate. Preferably these springs will be made of tungsten although molybdenum or other materials may be used. These springs 926 flex according to the thermal expansion of the electron emitter assembly 916, providing a reliable interconnect method.

The bases of the springs are preferably located into thin walled tubes 934 with poor thermal conductivity but good electrical conductivity that provide electrical connection to an underlying ceramic circuit board 928. Typically, this underlying circuit board 928 will provide vacuum feedthrus for the control/power signals that are individually controlled on an emitter-by-emitter basis. The circuit board is best made of a material with low outgassing properties such as alumina ceramic.

An alternative configuration inverts the thin walled tube 934 and spring assembly 926 such that the tube 934 runs at high temperature and the spring 926 at low temperature as shown in FIG. 18. This affords a greater choice of spring materials since creeping of the spring is reduced at lower temperatures.

It is advantageous in this design to use wraparound or through-hole Pt interconnects 924 on the AlN substrate 920 between the top emission surface and the bottom interconnect point 924 as shown in FIGS. 16*a* and 16*b*. Alternatively, a clip arrangement may be used to connect the electrical power source to the top surface of the AlN substrate.

It is clear that alternative assembly methods can be used including welded assemblies, high temperature soldered assemblies and other mechanical connections such as press-studs and loop springs.

AlN is a wide bandgap semiconductor material and a semiconductor injecting contact is formed between Pt and AlN. To reduce injected current that can occur at high operating temperatures, it is advantageous to convert the injecting contact to a blocking contact. This may be achieved, for example, by growing an aluminium oxide layer on the surface of the AlN substrate 920 prior to fabrication of the Pt metallisation.

Alternatively, a number of other materials may be used in place of Pt, such as tungsten or nickel. Typically, such metals may be sintered into the ceramic during its firing process to give a robust hybrid device.

In some cases, it is advantageous to coat the metal on the AlN substrate with a second metal such as Ni. This can help to extend lifetime of the oxide emitter or control the resistance of the heater, for example.

In a further embodiment the heater element 922 is formed on the back of the emitter block 917 so that the underside of the emitter block 917 of FIG. 16*a* is as shown in FIG. 16*b*. The conductive pads 924 shown in FIGS. 16*a* and 16*b* are then the same component, and provide the electrical contacts to the connector elements 926.

The invention claimed is:

1. An electron source for an X-ray scanner comprising:

a. at least one electron emitter in a first plane, wherein said electron emitter is positioned between a first suppressor and a second suppressor and wherein each of said first and second suppressors are held at a constant voltage;

b. plurality of extraction elements in a second plane, wherein the first plane and second plane are substantially parallel and separated by a contiguous space, and wherein a space between two adjacent extraction elements and said at least one electron emitter define a source region; and c. a controller that applies an electrical potential to certain of said plurality of extraction elements wherein said application of the electrical potential causes electrons to be moved from a first source region to a second source region.

2. The electron source of claim 1 wherein said extraction elements are substantially perpendicular to the at least one electron emitter.

3. The electron source according to claim 1 wherein the electron emitter comprises an elongate emitter member.

4. The electron source according to claim 3 wherein the extraction elements comprise parallel elongate members.

5. The electron source according to claim 1 wherein the controller is arranged to connect each of the plurality of extraction elements to either an extracting electrical potential which is positive with respect to the electron emitter or an inhibiting electrical potential which is negative with respect to the electron emitter.

6. The electron source according to claim 5 wherein the controller is arranged to connect the extraction elements to the extracting potential successively in adjacent pairs so as to direct a beam of electrons between each pair of extraction elements.

7. The electron source according to claim 6 wherein each of the extraction elements is connected to the same electrical potential as either of the extraction elements which are adjacent to it.

8. The electron source according to claim 6 wherein the controller connects the extraction elements to either side of an adjacent pair to the inhibiting potential while each of said adjacent pairs is connected to the extracting potential.

9. The electron source according to claim 8 wherein the controller connects all remaining extraction elements to the inhibiting potential while each of said adjacent pairs is connected to the extracting potential.

10. The electron source according to claim 5 wherein the extraction elements are spaced from the electron emitter such that if a group of one or more adjacent extraction elements are switched to the extracting potential, electrons will be extracted from a length of the electron emitter which is longer than the width of the source regions defined by said extraction elements.

11. The electron source according to claim 10 wherein the extraction elements are spaced from the electron emitter by a distance which is at least substantially equal to the distance between adjacent extraction elements.

12. The electron source according to claim 10 wherein the extraction elements are spaced from the electron emitter by a distance of 5 mm.

13. The electron source according to claim 10 wherein the extraction elements are arranged to at least partially focus the extracted electrons into a beam.

14. The electron source according to claim 1 wherein the extraction elements comprise wires.

15. The electron source according to claim 1 wherein the extraction elements are spaced from the electron emitter by a distance approximately equal to the distance between adjacent extraction elements.

16. The electron source according to claim 1 further comprising a plurality of focusing elements arranged to focus beams of electrons after they have passed the extraction elements.

17. The electron source according to claim 16 wherein the focusing elements are elongate.

18. The electron source according to claim 16 wherein the focusing elements are parallel to the extraction elements.

19. The electron source according to claim 18 wherein the focusing elements are aligned with the extraction elements such that electrons passing between any pair of the extraction elements will pass between a corresponding pair of focusing elements.

20. The electron source according to claim 19 wherein the focusing elements are spaced at equal intervals relative to the extraction elements.

21. The electron source according to claim 16 wherein the focusing elements are arranged to be connected to an electric potential which is positive with respect to the electron emitter.

22. The electron source according to claim 21 wherein the focusing elements are arranged to be connected to an electric potential which is negative with respect to the extraction elements.

23. The electron source according to claim 16 wherein the controller is arranged to control the potential applied to the focusing elements in order to control focusing of the beams of electrons.

24. The electron source according to claim 16 wherein the focusing elements comprise wires.

25. The electron source according to claim 16 wherein each focusing element is spaced at a distance between and in front of each adjacent pair of electron emitters.

26. The electron source according to claim 1 wherein the source regions are formed on respective electron emitters which are electrically insulated from each other and the controller is arranged to vary the electric potential of the electron emitters to control said relative electric potentials.

27. The electron source according to claim 26 wherein the extraction elements are held at a constant potential.

28. The electron source according to claim 27 further comprising focusing elements held at a constant potential.

29. The electron source according to claim 28 wherein the focusing elements are held at the same potential as the extraction elements.

30. The electron source according to claim 1 wherein the controller activates each of the source regions in turn.

31. The electron source according to claim 1 wherein the controller controls the electric potentials of the source regions and the extraction elements to extract electrons from a plurality of successive groupings of said source regions.

32. An X-ray tube comprising the electron source of claim 1.

33. The electron source according to claim 1 wherein said constant voltage is between 3 to 5 volts.

* * * * *